US007153097B2

(12) United States Patent
Kawabata et al.

(10) Patent No.: US 7,153,097 B2
(45) Date of Patent: Dec. 26, 2006

(54) CENTRIFUGAL IMPELLER AND PUMP APPARATUS

(75) Inventors: Junya Kawabata, Tokyo (JP); Takashi Enomoto, Tokyo (JP); Shoji Ito, Tokyo (JP)

(73) Assignee: Ebara Corporation, Tokyo (JP)

( * ) Notice: Subject to any disclaimer, the term of this patent is extended or adjusted under 35 U.S.C. 154(b) by 28 days.

(21) Appl. No.: 10/524,849

(22) PCT Filed: Aug. 27, 2003

(86) PCT No.: PCT/JP03/10836

§ 371 (c)(1),
(2), (4) Date: Feb. 18, 2005

(87) PCT Pub. No.: WO2004/020836

PCT Pub. Date: Mar. 11, 2004

(65) Prior Publication Data

US 2006/0120866 A1 Jun. 8, 2006

(30) Foreign Application Priority Data

Aug. 28, 2002 (JP) ..... 2002-249611

(51) Int. Cl.
*F01D 1/02* (2006.01)

(52) U.S. Cl. ..... 415/206; 415/203

(58) Field of Classification Search ..... 415/203, 415/206

See application file for complete search history.

(56) References Cited

U.S. PATENT DOCUMENTS

| | | | | |
|---|---|---|---|---|
| 2,390,504 | A * | 12/1945 | Berger | 415/198.1 |
| 2,648,492 | A * | 8/1953 | Stalker | 415/181 |
| 3,205,828 | A | 9/1965 | Rupp | |
| 4,752,187 | A | 6/1988 | Hergt et al. | |

FOREIGN PATENT DOCUMENTS

| | | |
|---|---|---|
| DE | 509-458 C | 10/1930 |
| FR | 1 002 707 A | 3/1952 |
| GB | 160474 A | 3/1921 |

* cited by examiner

*Primary Examiner*—Hoang Nguyen
(74) *Attorney, Agent, or Firm*—Westerman, Hattori, Daniels & Adrian, LLP.

(57) ABSTRACT

The centrifugal impeller includes a plurality of blades (3), a plurality of fluid paths (P) for delivering a fluid from an impeller inlet (1) to an impeller outlet (2), and a shroud (4) and a hub (5) for forming the fluid paths (P). Each of the fluid paths (P) is formed between adjacent two of the blades (3). A curved line (L3) of the shroud (4) curves so as to project toward the hub (5) in a region from a blade inlet (A) to a predetermined position (C) of the blade (3), and the curved line (L3) curves so as to project toward the opposite side of the hub (5) in a region from the predetermined position (C) to a blade outlet (B).

10 Claims, 6 Drawing Sheets

CENTRIFUGAL IMPELLER AND PUMP APPARATUS

TECHNICAL FIELD

The present invention relates to a centrifugal impeller and a pump apparatus, and more particularly to a centrifugal impeller used in a centrifugal pump such as a volute pump to pressurize a fluid by imparting kinetic energy to the fluid due to a centrifugal force, and a pump apparatus having such a centrifugal impeller.

BACKGROUND ART

In a centrifugal impeller shown in FIGS. 1A and 1B, an inlet width $B_1$ and an outlet width $B_2$ of a blade 110, an inlet diameter $D_0$ and an outlet diameter $D_2$ of the centrifugal impeller, and an inlet angle $\beta_1$ and an outlet angle $\beta_2$ of the blade 110 are designed so as to satisfy a required flow rate and a required pump head. In the conventional centrifugal impeller, it is desirable to change the width of the blade 110 gradually from the inlet width $B_1$ to the outlet width $B_2$, and it is also desirable to change the angle of the blade 110 gradually from the inlet angle $\beta_1$ to the outlet angle $\beta_2$.

FIGS. 2A and 2B are meridional-plane cross-sectional views showing a conventional centrifugal impeller designed as stated above. As shown in FIGS. 2A and 2B, the centrifugal impeller has a plurality of blades 110 disposed between a shroud 120 and a hub 130 (only one blade is shown in FIGS. 2A and 2B). The blades 110 are arranged at angularly equal intervals in a circumferential direction of the centrifugal impeller. A fluid path 140 is formed by adjacent two of the blades 110, the shroud 120, and the hub 130 so that a fluid flows through the fluid path 140. In the conventional centrifugal impeller shown in FIG. 2A, the shroud 120 curves entirely so as to project toward the hub 130 to form a curved line $L_1$. In the conventional centrifugal impeller shown in FIG. 2B, the shroud 120 is inclined straightly toward the hub 130 to form a straight line $L_2$.

However, as shown in FIGS. 2A and 2B, if the curved line $L_1$ or the straight line $L_2$ is formed at the shroud 120, a meridional length of the fluid path 140 becomes long and a width of the whole fluid path 140 in the meridional-plane cross-section becomes small in the case of the centrifugal impeller of a small flow rate and a high pump head, i.e. a small specific speed (Ns). Consequently, a relative velocity of the fluid flowing through the fluid path 140 becomes large, and hence a friction loss in the fluid path 140 is increased, thus lowering an impeller performance.

DISCLOSURE OF INVENTION

The present invention has been made in view of the above drawbacks. It is therefore an object of the present invention to provide a centrifugal impeller which can reduce an internal loss in a fluid path to exhibit an excellent performance even if the centrifugal impeller has a small specific speed, and to provide a pump apparatus having such a centrifugal impeller.

In order to achieve the above object, according to one aspect of the present invention, there is provided a centrifugal impeller comprising: a plurality of blades disposed between an impeller inlet and an impeller outlet; a plurality of fluid paths for delivering a fluid from the impeller inlet to the impeller outlet with the rotation of the centrifugal impeller, each of the fluid paths being formed between adjacent two of the blades; and a shroud and a hub for forming the fluid paths; wherein in a meridional-plane cross-section of the centrifugal impeller, a curved line of the shroud, which forms the fluid path, curves so as to project toward the hub in a region from a blade inlet to a predetermined position of the blade, and the curved line curves so as to project toward the opposite side of the hub in a region from the predetermined position of the blade to a blade outlet.

In a preferred aspect of the present invention, the predetermined position is located near a center of the blade in a meridional plane.

According to the present invention, compared to the conventional centrifugal impeller, the relative velocity of the fluid flowing through the fluid path can be reduced. Specifically, in the conventional centrifugal impeller, a meridional velocity of the fluid flowing through the fluid path is substantially constant in a region from the blade inlet to the blade outlet. In contrast thereto, in the centrifugal impeller according to the present invention, the fluid path can be widened in a region from the blade inlet to the predetermined position, e.g. a position near the center of the blade, and hence a meridional velocity of the fluid flowing through the fluid path can be reduced greatly. Therefore, the internal loss in the fluid path can be reduced, and hence the excellent impeller performance can be obtained even if the centrifugal impeller has a small specific speed.

In a preferred aspect of the present invention, stream lines formed at a side of the hub and a side of the shroud correspond to each other when viewed in an axial direction of the centrifugal impeller.

In a preferred aspect of the present invention, a distance between adjacent two of the blades is gradually increased from the blade inlet to the predetermined position of the blade, and is decreased from the predetermined position of the blade toward the blade outlet.

According to the present invention, because a region where a fluid velocity is reduced can be extended to the downstream side of the fluid path compared to the conventional centrifugal impeller, a friction between the fluid and the fluid path can be reduced. Further, because non-uniformity of velocity distribution at the blade outlet can be improved, a shearing force produced in the fluid can be reduced, and hence a loss at the downstream region of the fluid path can be reduced. The non-uniformity of velocity distribution herein refers to non-uniformity of a fluid velocity in a direction perpendicular to a flowing direction of the fluid.

According to another aspect of the present invention, there is provided a centrifugal impeller comprising: a plurality of blades disposed between an impeller inlet and an impeller outlet; a plurality of fluid paths for delivering a fluid from the impeller inlet to the impeller outlet with the rotation of the centrifugal impeller, each of the fluid paths being formed between adjacent two of the blades; and a shroud and a hub for forming the fluid paths; wherein a distance between adjacent two of the blades is gradually increased from a blade inlet to a predetermined position of the blade, and is decreased from the predetermined position of the blade toward a blade outlet.

In a preferred aspect of the present invention, the predetermined position of the blade is located near a center of the blade in a meridional plane.

In a preferred aspect of the present invention, stream lines formed at a side of the hub and a side of the shroud correspond to each other when viewed in an axial direction of the centrifugal impeller.

According to another aspect of the present invention, there is provided a pump apparatus comprising: the centrifugal impeller; a casing for housing the centrifugal impeller; and a rotatable main shaft to which the centrifugal impeller is attached.

BEST MODE FOR CARRYING OUT THE INVENTION

Figure 1A:
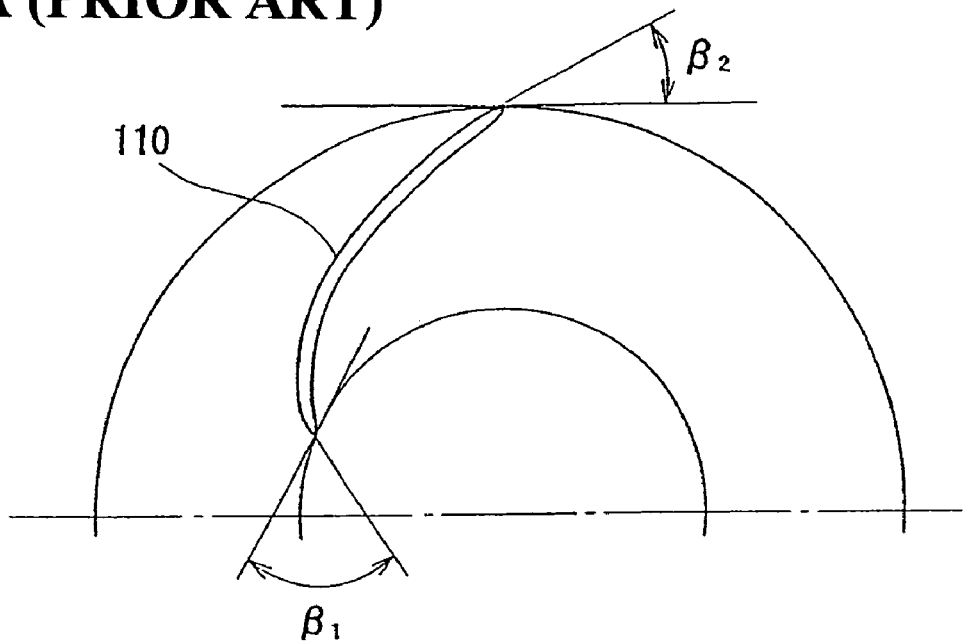
FIG. 1A (PRIOR ART)
FIG. 1A is a cross-sectional view showing a general centrifugal impeller.
Figure 1B:
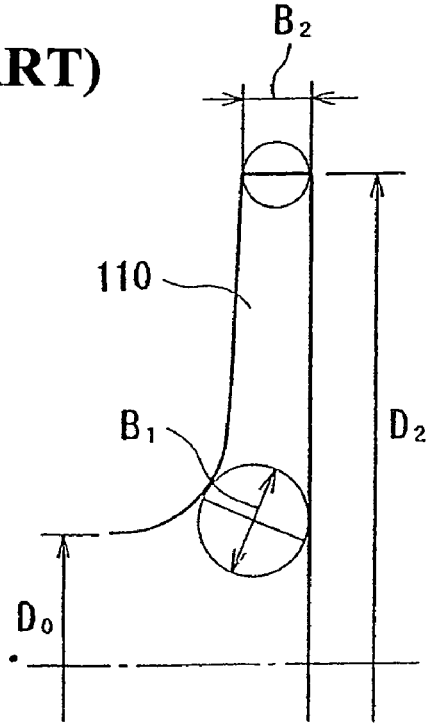
FIG. 1B (PRIOR ART)
FIG. 1B is a meridional-plane cross-sectional view showing the general centrifugal impeller.
Figure 2A:
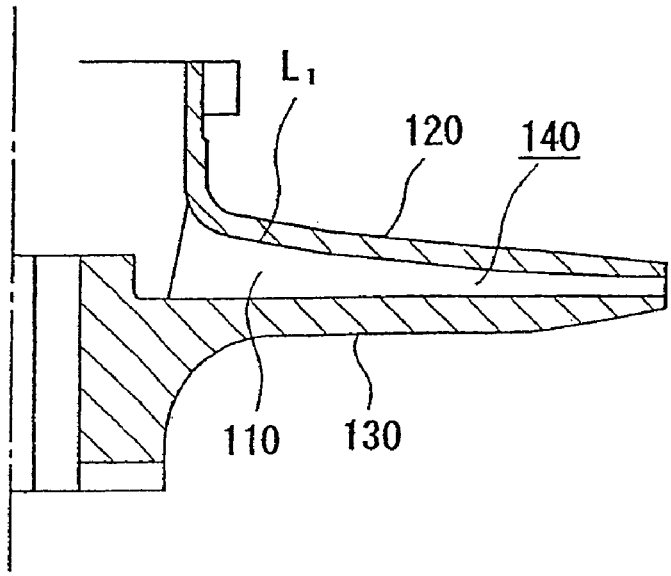
FIG. 2A (PRIOR ART)
FIG. 2A is a meridional-plane cross-sectional view showing a conventional centrifugal impeller whose shroud curves so as to project toward a hub.
Figure 2B:
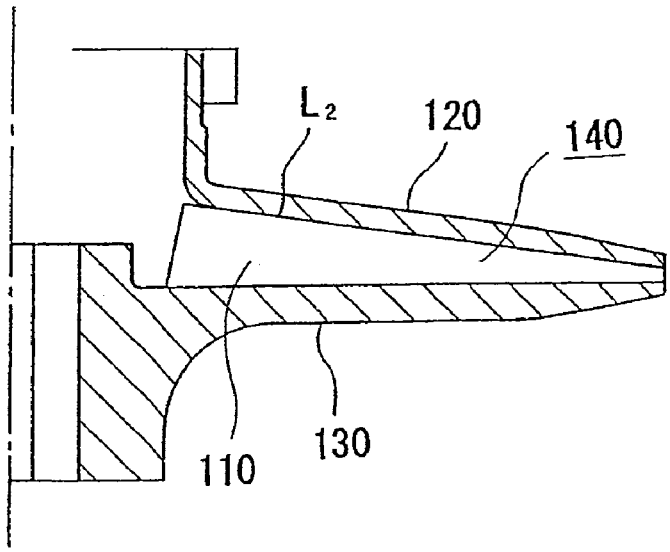
FIG. 2B (PRIOR ART)
FIG. 2B is a meridional-plane cross-sectional view showing a conventional centrifugal impeller whose shroud is inclined straightly toward a hub.
Figure 3:
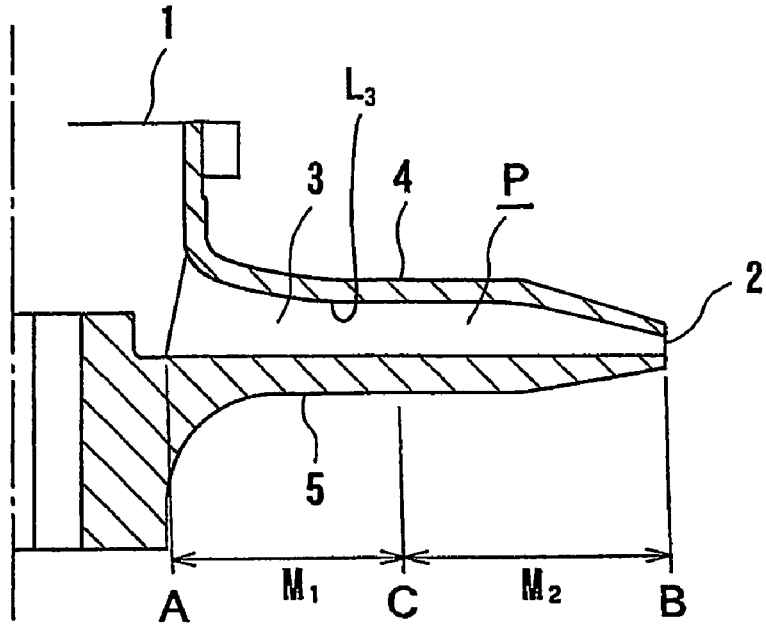
FIG. 3 is a meridional-plane cross-sectional view showing a centrifugal impeller according to a first embodiment of the present invention.
Figure 4:
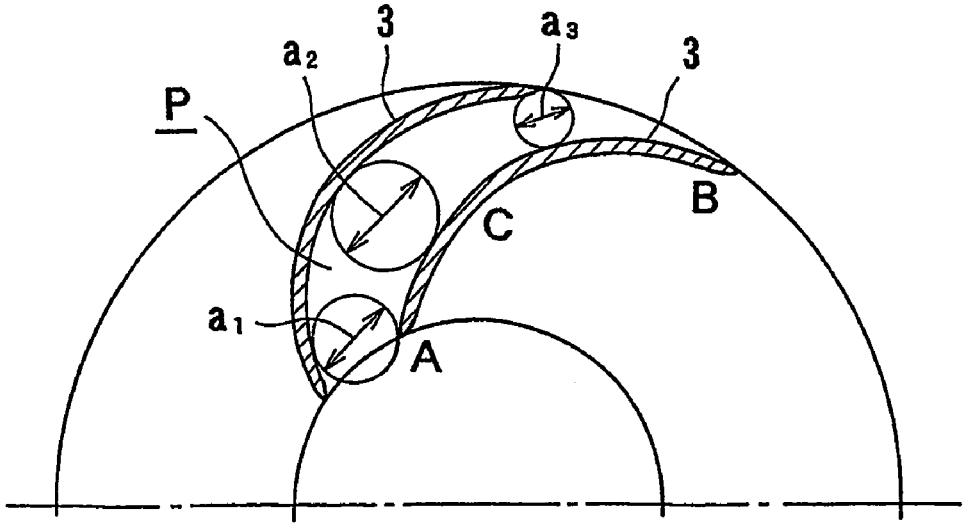
FIG. 4 is a cross-sectional view of the centrifugal impeller shown in FIG. 3.

A centrifugal impeller according to an embodiment of the present invention will be described below with reference to the drawings. FIG. 3 is a meridional-plane cross-sectional view showing a centrifugal impeller according to a first embodiment of the present invention. FIG. 4 is a cross-sectional view of the centrifugal impeller shown in FIG. 3.

As shown in FIGS. 3 and 4, a centrifugal impeller comprises a plurality of blades 3 (only adjacent two of the blades 3 are shown in FIG. 4), a shroud (tip) 4, and a hub 5. The blades 3 are disposed between the shroud 4 and the hub 5 along an axial direction of the centrifugal impeller and also disposed between an impeller inlet 1 positioned at a central side of the centrifugal impeller and an impeller outlet 2 positioned at a circumferential side of the centrifugal impeller. The blades 3 are arranged at angularly equal intervals in a circumferential direction of the centrifugal impeller and extend outwardly spirally. A plurality of fluid paths P are formed between the adjacent blades 3 so that a fluid is delivered through the fluid paths P from the impeller inlet 1 to the impeller outlet 2 with the rotation of the centrifugal impeller. Specifically, spaces surrounded by the adjacent blades 3, the shroud 4, and the hub 5 constitute the fluid paths P, respectively. Only one of the fluid paths P is shown in FIGS. 3 and 4. As shown in FIG. 4, the centrifugal impeller of this embodiment comprises a two-dimensional impeller whose stream lines at a side of the hub 5 and a side of the shroud 4 correspond to each other when viewed in the axial direction of the centrifugal impeller. Specifically, the respective blades 3 extend from the hub 5 to the shroud 4 in a direction perpendicular to a surface of the hub 5.

In the meridional-plane cross-section of the centrifugal impeller shown in FIG. 3, a curved line $L_3$ of the shroud 4, which forms the fluid path P, curves so as to project toward the hub 5 in a region of a meridional length $M_1$ from a blade inlet A to a position C near the center of the blade 3 in a meridional plane (hereinafter referred to as a near-center position C) so that the fluid path P is widened from the blade inlet A to the near-center position C. The curved line $L_3$ also curves so as to project toward the opposite side of the hub 5 in a region of a meridional length $M_2$ from the near-center position C to a blade outlet B so that the fluid path P is widened at a region downstream of the near-center position C and narrowed sharply in the vicinity of the blade outlet B.

Figure 5A:
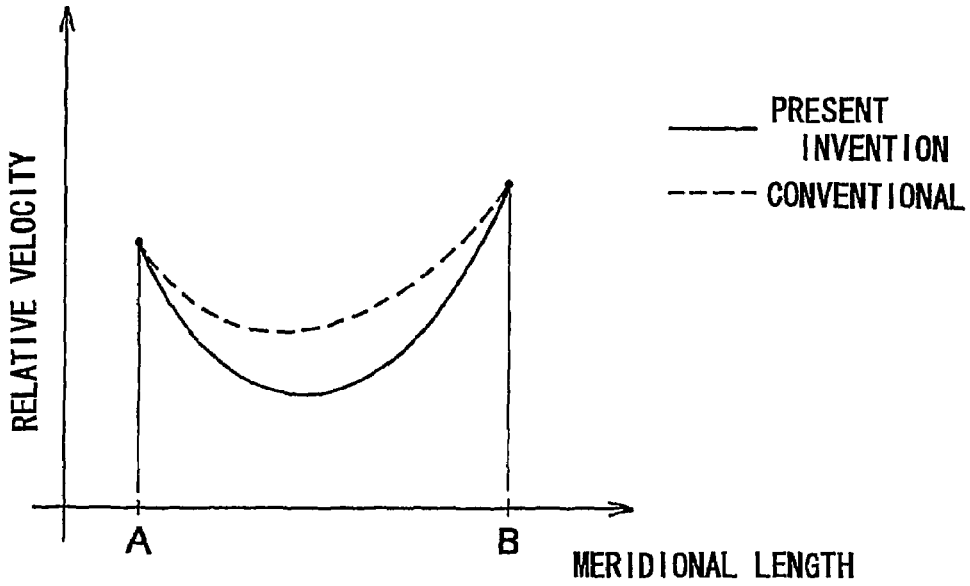
FIG. 5A is a graph comparing a relative velocity of a fluid of the centrifugal impeller according to the present invention to that of the conventional centrifugal impeller.
Figure 5B:
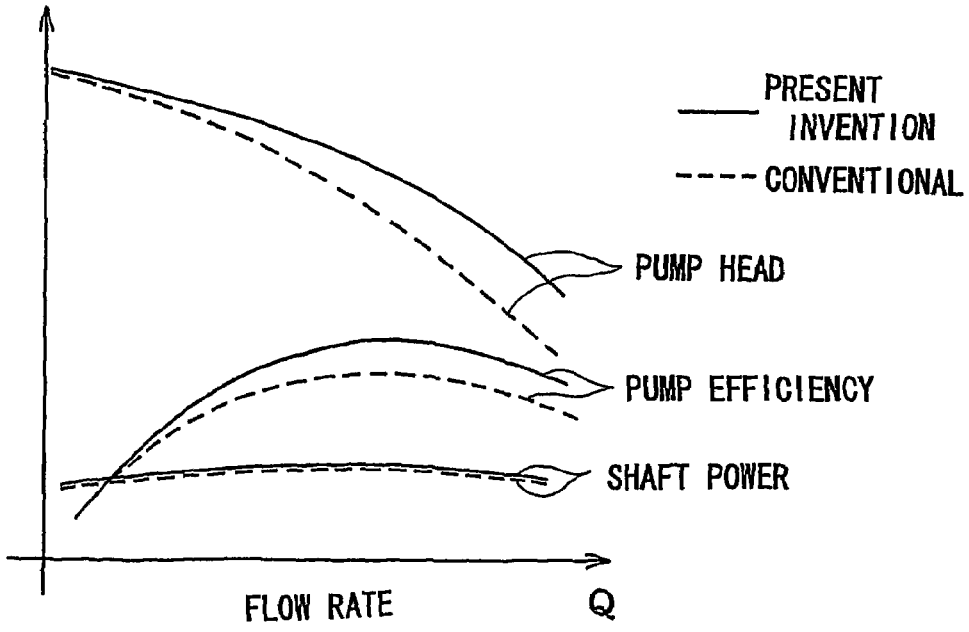
FIG. 5B is a graph comparing characteristics of the centrifugal impeller according to the present invention to those of the conventional centrifugal impeller.

With this structure, since the fluid path P can be widened in the region from the blade inlet A to the near-center position C, a meridional velocity of the fluid flowing through the fluid path P can be reduced greatly, and hence a relative velocity of the fluid in the fluid path P can be reduced compared to the conventional centrifugal impeller. Further, since the fluid path P is narrowed in the vicinity of the blade outlet B, a flow rate of the fluid discharged from the centrifugal impeller is reduced, and hence a desired flow rate can be obtained. FIG. 5A is a graph comparing the relative velocity of the fluid of the centrifugal impeller according to the present invention to that of the conventional centrifugal impeller, and FIG. 5B is a graph comparing characteristics of the centrifugal impeller according to the present invention to those of the conventional centrifugal impeller. In FIGS. 5A and 5B, solid lines represent the present invention, and broken lines represent the conventional.

As shown in FIG. 5A, according to the centrifugal impeller of the present invention, the relative velocity of the fluid can be reduced in a region from the blade inlet A to the blade outlet B, compared to the conventional centrifugal impeller. Therefore, since an internal loss in the fluid path P can be reduced, an excellent impeller performance can be obtained even if the impeller has a small specific speed. Further, as shown in FIG. 5A, in the centrifugal impeller of the present invention, since the relative velocity of the fluid at the blade outlet B does not change compared to the conventional centrifugal impeller, Euler head also does not change, and hence a shaft power is not increased and a pump efficiency is increased, as shown in FIG. 5B. Euler head is defined as a theoretical head given by Euler's equation.

In the cross-sectional view shown in FIG. 4, a distance between the adjacent blades 3 is set such that a distance $a_1$ at the blade inlet A is smaller than a distance $a_2$ at the near-center position C ($a_1<a_2$) and a distance $a_3$ at the blade outlet B is smaller than the distance $a_2$ ($a_3<a_2$), so that the distance between the adjacent blades 3 is gradually increased from the blade inlet A toward the near-center position C, and is decreased from the near-center position C toward the blade outlet B. Since the distance $a_1$ at the blade inlet A and the distance $a_2$ at the near-center position C are large, a region where the fluid velocity is reduced can be extended to a downstream side of the fluid path P compared to the conventional centrifugal impeller. Therefore, the centrifugal impeller of the present invention can reduce a fluid friction between the fluid and the fluid path P compared to the conventional centrifugal impeller. Further, since the distance $a_3$ is smaller than the distance $a_2$, non-uniformity of velocity distribution at the blade outlet B can be improved. Accordingly, a shearing force produced in the fluid can be reduced, and hence a loss at the downstream region of the fluid path P can be reduced.

Figure 6A:
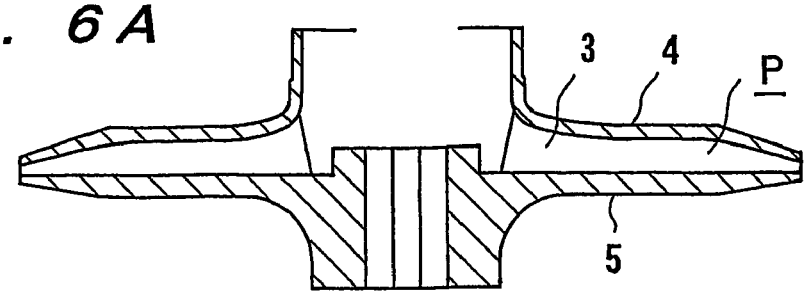
FIGS. 6A through 6E are views showing examples of designs of the centrifugal impeller according to the present invention, FIG. 6A showing the centrifugal impeller having a specific speed of 120, FIG. 6B showing the centrifugal impeller having a specific speed of 140, FIG. 6C showing the centrifugal impeller having a specific speed of 200, FIG. 6D showing the centrifugal impeller having a specific speed of 240, and FIG. 6E showing the centrifugal impeller having a specific speed of 280.
Figure 6B:
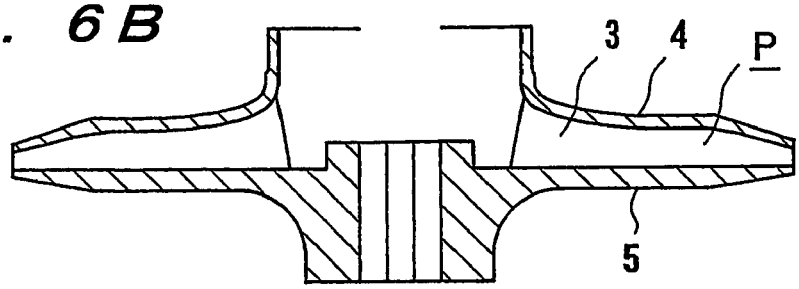
Figure 6C:
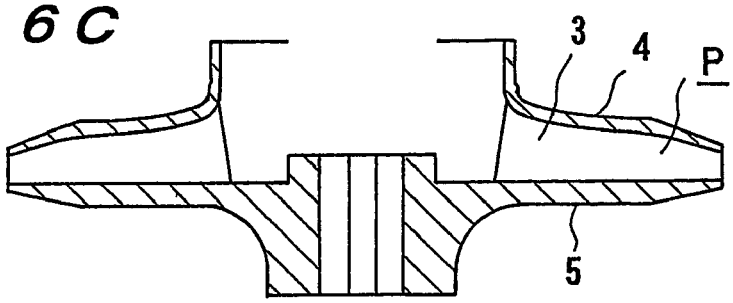
Figure 6D:
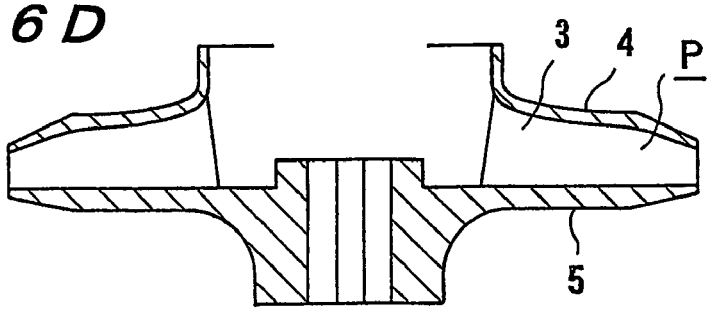
Figure 6E:
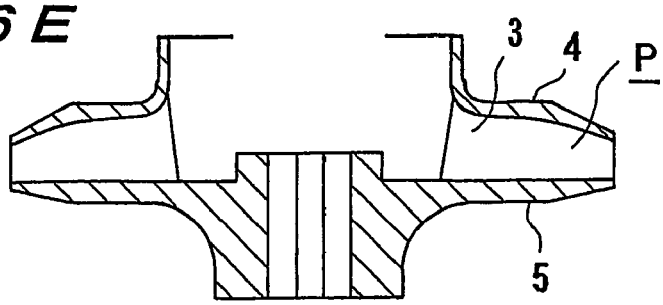

The shape of the centrifugal impeller of the present invention can be reproduced using a three-dimensional inverse design method. The three-dimensional inverse design method is a design technique in which a blade loading distribution is specified and a blade geometry which will realize the specified blade loading distribution is determined by numeral calculation. Theory of the three-dimensional inverse design method is described in detail in the following literature: Zangeneh, M., 1991, "A Compressible Three-Dimensional Design Method for Radial and Mixed Flow Turbomachinery Blades", Int. J. Numerical Methods in Fluids, Vol. 13, pp. 599–624. FIGS. 6A through 6E are views showing examples of designs of the centrifugal impeller according to the present invention and showing modifications of the centrifugal impeller whose specific speed increases gradually from FIG. 6A to FIG. 6E. FIG. 6A shows the centrifugal impeller having a specific speed of 120, FIG. 6B shows the centrifugal impeller having a specific speed of 140, FIG. 6C shows the centrifugal impeller having a specific speed of 200, FIG. 6D shows the centrifugal impeller having a specific speed of 240, and FIG. 6E shows the centrifugal impeller having a specific speed of 280.

In the centrifugal impeller, there are a friction loss due to a fluid friction between the fluid and an inner surface of the fluid path, and a mixing loss due to the non-uniformity of velocity distribution. In general, the lower the specific speed is, the higher the friction loss is. According to the present invention, since the relative velocity of the fluid flowing through the fluid path can be small, the friction loss can be reduced. Therefore, the centrifugal impeller according to the present invention is effective in an impeller having a small specific speed, and it is possible to construct a pump apparatus having an excellent pump performance by using the centrifugal impeller of the present invention attached to a rotatable main shaft.

Figure 7:
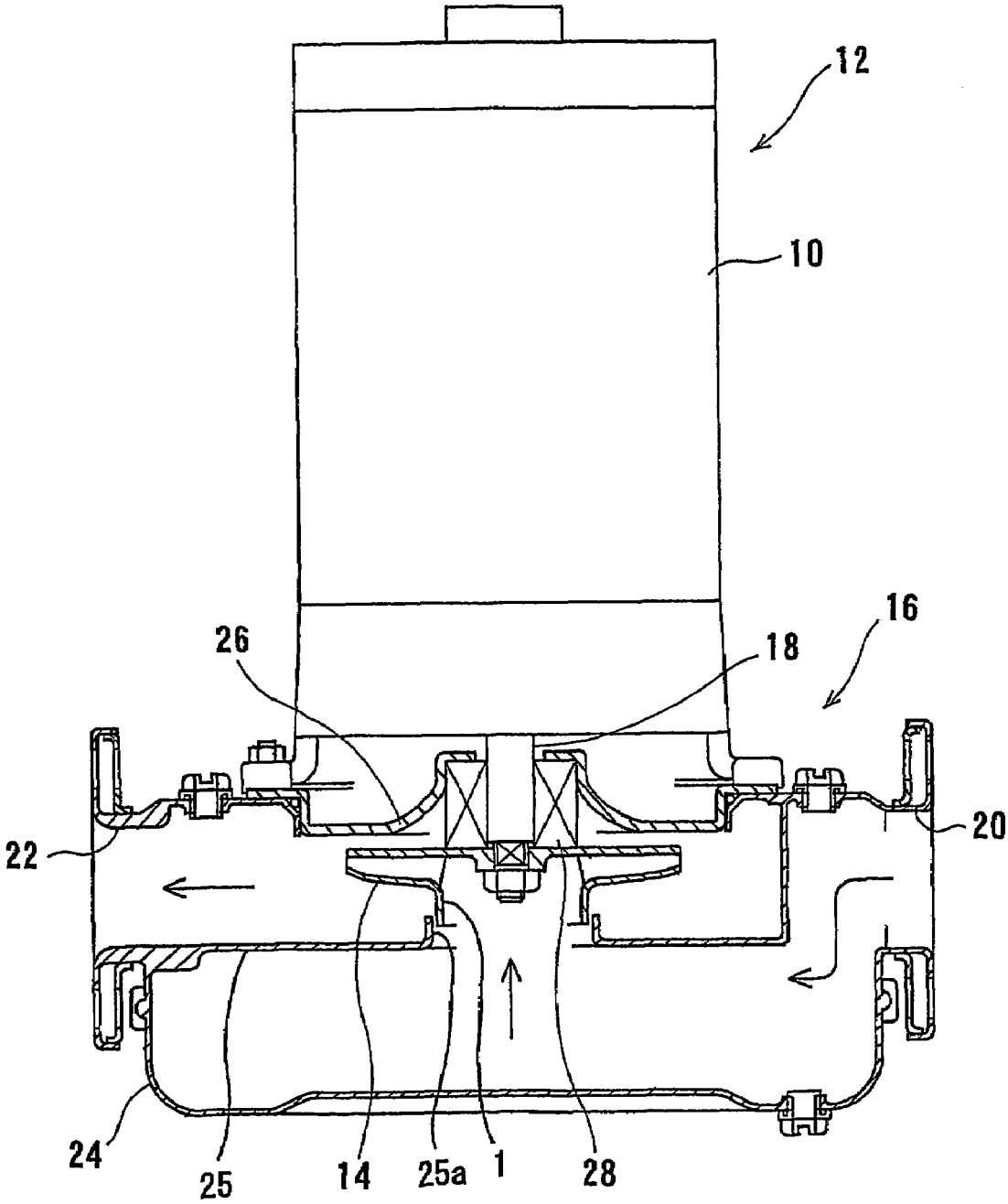
FIG. 7 is a vertical cross-sectional view showing an example of a pump apparatus having the centrifugal impeller according to the present invention.

FIG. 7 is a vertical cross-sectional view showing an example of a pump apparatus having the centrifugal impeller according to the present invention. The pump apparatus shown in FIG. 7 is only an example of an application of the present invention, and the centrifugal impeller of the present invention can be applied to all types of pump apparatuses.

The pump apparatus shown in FIG. 7 comprises a motor section 12 having a motor 10, a pump section 16 in which the centrifugal impeller 14 according to the present invention is incorporated. A main shaft 18 extends from the motor section 12 to the pump section 16, and the centrifugal impeller 14 is fixed to a lower end portion of the main shaft 18. With this structure, a driving force generated by the motor 10 of the motor section 12 is transmitted to the centrifugal impeller 14 of the pump section 16 through the main shaft 18, thereby rotating the centrifugal impeller 14 together with the main shaft 18.

The pump section 16 comprises a casing 24 having a suction port 20 and a discharge port 22, and an intermediate casing 25 housed in the casing 24. The centrifugal impeller 14 is housed in the intermediate casing 25 in such a state that an impeller inlet 1 of the centrifugal impeller 14 faces downwardly. The intermediate casing 25 has an opening portion 25*a* at a lower portion thereof for allowing an interior of the intermediate casing 25 to communicate with an interior of the casing 24. The suction port 20 is located at one side portion of the casing 24 and communicates with the interior of the casing 24, and the discharge port 22 is located at the opposite side portion of the casing 24 and communicates with the interior of the intermediate casing 25. A casing cover 26 is provided between the intermediate casing 25 and the motor section 12 to cover an opening of the intermediate casing 25. A mechanical seal 28 is disposed at a central portion of the casing cover 26 for thereby preventing a pressurized fluid in the pump section 16 from entering the motor section 12.

In the pump apparatus having such a structure, the driving force of the motor 10 is transmitted to the centrifugal impeller 14 fixed to the lower end portion of the main shaft 18, and kinetic energy is imparted to the fluid (liquid) in the casing 24 by the rotation of the centrifugal impeller 14. Therefore, when the centrifugal impeller 14 is rotated by energizing the motor 10, the fluid is sucked from the suction port 20 into the interior of the casing 24, and is pressurized and then discharged from the discharge port 22.

While the present invention has been described with reference to an embodiment thereof, many modifications and variations may be made in the present invention without departing from the spirit and scope of the present invention.

As described above, according to the present invention, compared to the conventional centrifugal impeller, the relative velocity of the fluid flowing through the fluid path can be reduced. Therefore, the internal loss in the fluid path can be reduced, and hence an excellent impeller performance can be obtained even if the centrifugal impeller has a small specific speed.

INDUSTRIAL APPLICABILITY

The present invention is applicable to a centrifugal impeller and a pump apparatus, and more particularly to a centrifugal impeller used in a centrifugal pump such as a volute pump to pressurize a fluid by imparting kinetic energy to the fluid due to a centrifugal force, and a pump apparatus having such a centrifugal impeller.

The invention claimed is:

1. A centrifugal impeller comprising:

a plurality of blades disposed between an impeller inlet and an impeller outlet;

a plurality of fluid paths for delivering a fluid from said impeller inlet to said impeller outlet with the rotation of said centrifugal impeller, each of said fluid paths being formed between adjacent two of said blades; and a shroud and a hub for forming said fluid paths;

wherein in a meridional-plane cross-section of said centrifugal impeller, a curved line of said shroud, which forms said fluid path, curves so as to project toward said hub in a region from a blade inlet to a predetermined position of said blade so that said fluid path is widened from said blade inlet to said predetermined position, and said curved line curves so as to project toward the opposite side of said hub in a region from said predetermined position of said blade to a blade outlet so that said fluid path is widened in a region downstream of said predetermined position and narrowed in the vicinity of said blade outlet.

2. A centrifugal impeller according to claim 1, wherein said predetermined position of said blade is located near a center of said blade in a meridional plane.

3. A centrifugal impeller according to claim 1 or 2, wherein stream lines formed at a side of said hub and a side of said shroud correspond to each other when viewed in an axial direction of said centrifugal impeller.

4. A centrifugal impeller according to claim 1 or 2, wherein a distance between adjacent two of said blades is gradually increased from said blade inlet to said predetermined position of said blade, and is decreased from said predetermined position of said blade toward said blade outlet.

5. A centrifugal impeller comprising:

a plurality of blades disposed between an impeller inlet and an impeller outlet, arranged at angularly equal intervals in a circumferential direction of said centrifugal impeller, and extending outwardly spirally;

a plurality of fluid paths for delivering a fluid from said impeller inlet to said impeller outlet with the rotation of said centrifugal impeller, each of said fluid paths being formed between adjacent two of said blades; and a shroud and a hub for forming said fluid paths;

wherein a distance between adjacent two of said blades is gradually increased from a blade inlet to a predetermined position of said blade, and is decreased from said predetermined position of said blade toward a blade outlet.

6. A centrifugal impeller according to claim 5, wherein said predetermined position of said blade is located near a center of said blade in a meridional plane.

7. A centrifugal impeller according to claim 5 or 6, wherein stream lines formed at a side of said hub and a side of said shroud correspond to each other when viewed in an axial direction of said centrifugal impeller.

8. A pump apparatus comprising:

a centrifugal impeller according to claim 1, 2, 5 or 6;

a casing for housing said centrifugal impeller; and a rotatable main shaft to which said centrifugal impeller is attached.

9. A centrifugal impeller according to claim 1, wherein in the meridional-plane cross-section, said hub has a straight line forming said fluid paths and being perpendicular to an axial direction of said centrifugal impeller.

10. A centrifugal impeller according to claim 9, wherein said straight line extends from at least said predetermined position to said blade outlet.

* * * * *